US009796571B2

(12) United States Patent
Singh et al.

(10) Patent No.: US 9,796,571 B2
(45) Date of Patent: Oct. 24, 2017

(54) WORK VEHICLE WITH IMPROVED IMPLEMENT POSITION CONTROL AND SELF-LEVELING FUNCTIONALITY

(71) Applicant: CNH Industrial America, LLC, New Holland, PA (US)

(72) Inventors: Aditya Singh, Westmount, IL (US); Duqiang Wu, Bolingbrook, IL (US); Navneet Gulati, Naperville, IL (US)

(73) Assignee: CNH Industrial America LLC, New Holland, PA (US)

( * ) Notice: Subject to any disclaimer, the term of this patent is extended or adjusted under 35 U.S.C. 154(b) by 0 days.

(21) Appl. No.: 14/819,736

(22) Filed: Aug. 6, 2015

(65) Prior Publication Data

US 2017/0036899 A1 Feb. 9, 2017

(51) Int. Cl.

| | |
|---|---|
| ***B66F 9/22*** | (2006.01) |
| ***E02F 3/43*** | (2006.01) |
| ***E02F 9/20*** | (2006.01) |

(52) U.S. Cl.

CPC ..... *B66F 9/22* (2013.01); *E02F 3/433* (2013.01); *E02F 3/437* (2013.01); *E02F 9/2041* (2013.01)

(58) Field of Classification Search

CPC . B66F 9/22; E02F 3/433–3/439; E02F 9/2041
See application file for complete search history.

(56) References Cited

U.S. PATENT DOCUMENTS

| | | | | |
|---|---|---|---|---|
| 4,844,685 | A * | 7/1989 | Sagaser | E02F 3/43 414/699 |
| 5,160,239 | A | 11/1992 | Allen et al. | |
| 5,184,932 | A | 2/1993 | Misuda et al. | |
| 5,356,260 | A | 10/1994 | Ikari et al. | |
| 5,807,061 | A | 9/1998 | Donoghue et al. | |
| 6,233,511 | B1 | 5/2001 | Berger et al. | |
| 6,763,619 | B2 | 7/2004 | Hendron et al. | |
| 7,140,830 | B2 | 11/2006 | Berger et al. | |
| 7,530,185 | B2 | 5/2009 | Trifunovic | |
| 7,949,449 | B2 | 5/2011 | Koch et al. | |
| 8,463,508 | B2 | 6/2013 | Nicholson et al. | |

(Continued)

FOREIGN PATENT DOCUMENTS

EP 2535464 A2 12/2012

OTHER PUBLICATIONS

European Search Report; 16180356.4-1712; dated Dec. 13, 2016.

*Primary Examiner* — Aaron L Troost
(74) *Attorney, Agent, or Firm* — Dority & Manning, P.A.

(57) ABSTRACT

A method for automatically adjusting the position of an implement for a work vehicle may generally include receiving an input associated with a flow-related parameter of the work vehicle as loader arms of the work vehicle are being moved and determining a speed control signal for the implement based at least in part on the flow-related parameter, wherein the speed control signal is associated with an implement speed at which the implement is to be moved in order to maintain the implement at a fixed orientation relative to a given reference point. In addition, the method may include generating a valve command signal based at least in part on the speed control signal and transmitting the valve command signal to a valve associated with the implement in order to maintain the implement at the fixed orientation as the loader arms are being moved.

20 Claims, 4 Drawing Sheets

(56) References Cited

U.S. PATENT DOCUMENTS

| | | | | |
|---|---|---|---|---|
| 8,612,103 | B2 | 12/2013 | Nicholson et al. | |
| 2004/0083628 | A1* | 5/2004 | Hendron | E02F 3/433 37/348 |
| 2005/0210713 | A1 | 9/2005 | Mennen et al. | |
| 2012/0057956 | A1 | 3/2012 | Shirao et al. | |
| 2012/0255293 | A1* | 10/2012 | Reedy | E02F 3/432 60/459 |
| 2012/0321425 | A1* | 12/2012 | Shatters | E02F 3/432 414/700 |
| 2013/0004282 | A1 | 1/2013 | Grimes et al. | |

* cited by examiner

WORK VEHICLE WITH IMPROVED IMPLEMENT POSITION CONTROL AND SELF-LEVELING FUNCTIONALITY

FIELD OF THE INVENTION

The present subject matter relates generally to work vehicles and, more particularly, to a system and method for automatically adjusting the orientation or angular position of an implement of a work vehicle so as to provide self-leveling functionality as the vehicle's boom or loader arms are being moved.

BACKGROUND OF THE INVENTION

Work vehicles having loader arms, such as skid steer loaders, telescopic handlers, wheel loaders, backhoe loaders, forklifts, compact track loaders and the like, are a mainstay of construction work and industry. For example, skid steer loaders typically include a pair of loader arms pivotally coupled to the vehicle's chassis that can be raised and lowered at the operator's command. The loader arms typically have an implement attached to their end, thereby allowing the implement to be moved relative to the ground as the loader arms are raised and lowered. For example, a bucket is often coupled to the loader arm, which allows the skid steer loader to be used to carry supplies or particulate matter, such as gravel, sand, or dirt, around a worksite.

When using a work vehicle to perform a material moving operation or any other suitable operation, it is often desirable to maintain the vehicle's bucket or other implement at a constant angular position relative to the vehicle's driving surface (or relative any other suitable reference point or location) as the loader arms are being raised and/or lowered. To achieve such control, conventional work vehicles typically rely on the operator manually adjusting the position of the implement as the loader arms are being moved. Unfortunately, this task is often quite challenging for the operator and can lead to materials being inadvertently dumped from the implement. To solve this problem, control systems have been described that attempt to provide a control algorithm, for automatically maintaining a constant angular implement position as the vehicle's loader arms are being moved. However, such previously disclosed automatic control systems still suffer from many drawbacks, including poor system responsiveness and imprecise implement position control.

Accordingly, an improved system and method for automatically adjusting the position of an implement of a work vehicle so as to maintain the implement at a desired angular orientation relative to a given reference point would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to a method for automatically adjusting the position of an implement of a lift assembly for a work vehicle, wherein the lift assembly includes a pair of loader arms coupled to the implement. The method may generally include receiving an input associated with a flow-related parameter of the work vehicle as the loader arms are being moved, wherein the flow-related parameter is indicative of or associated with a flow of hydraulic fluid supplied to or within a cylinder for controlling the movement of the implement. The method may also include determining a speed control signal for the implement based at least in part on the flow-related parameter, wherein the speed control signal is associated with an implement speed at which the implement is to be moved in order to maintain the implement at a fixed orientation relative to a given reference point. In addition, the method may include generating a valve command signal based at least in part on the speed control signal and transmitting the valve command signal to a valve associated with the implement in order to maintain the implement at the fixed orientation as the loader arms are being moved.

In another aspect, the present subject matter is directed to a system for controlling the operation of a work vehicle. The system may generally include a lift assembly having an implement and a pair of loader arms coupled to the implement. The system may include a tilt valve in fluid communication with a corresponding tilt cylinder. The tilt valve may be configured to control a supply hydraulic fluid to the tilt cylinder in order to adjust the position of the implement relative to the loader arms. In addition, the system may include a controller communicatively coupled to the tilt valve. The controller may include at least one processor and associated memory. The memory may store instructions that, when implemented by the processor(s), configure the controller receive an input associated with a flow-related parameter of the work vehicle as the loader arms are being moved, wherein the flow-related parameter is indicative of or associated with the hydraulic fluid supplied to or within the tilt cylinder. The controller may also be configured to determine a speed control signal for the implement based at least in part on the flow-related parameter, wherein the speed control signal is associated with an implement speed at which the implement is to be moved in order to maintain the implement at a fixed orientation relative to a given reference point. In addition, the controller may be configured to generate a valve command signal based at least in part on the speed control signal and transmit the valve command signal to the tilt valve in order to maintain the implement at the fixed orientation as the loader arms are being moved.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
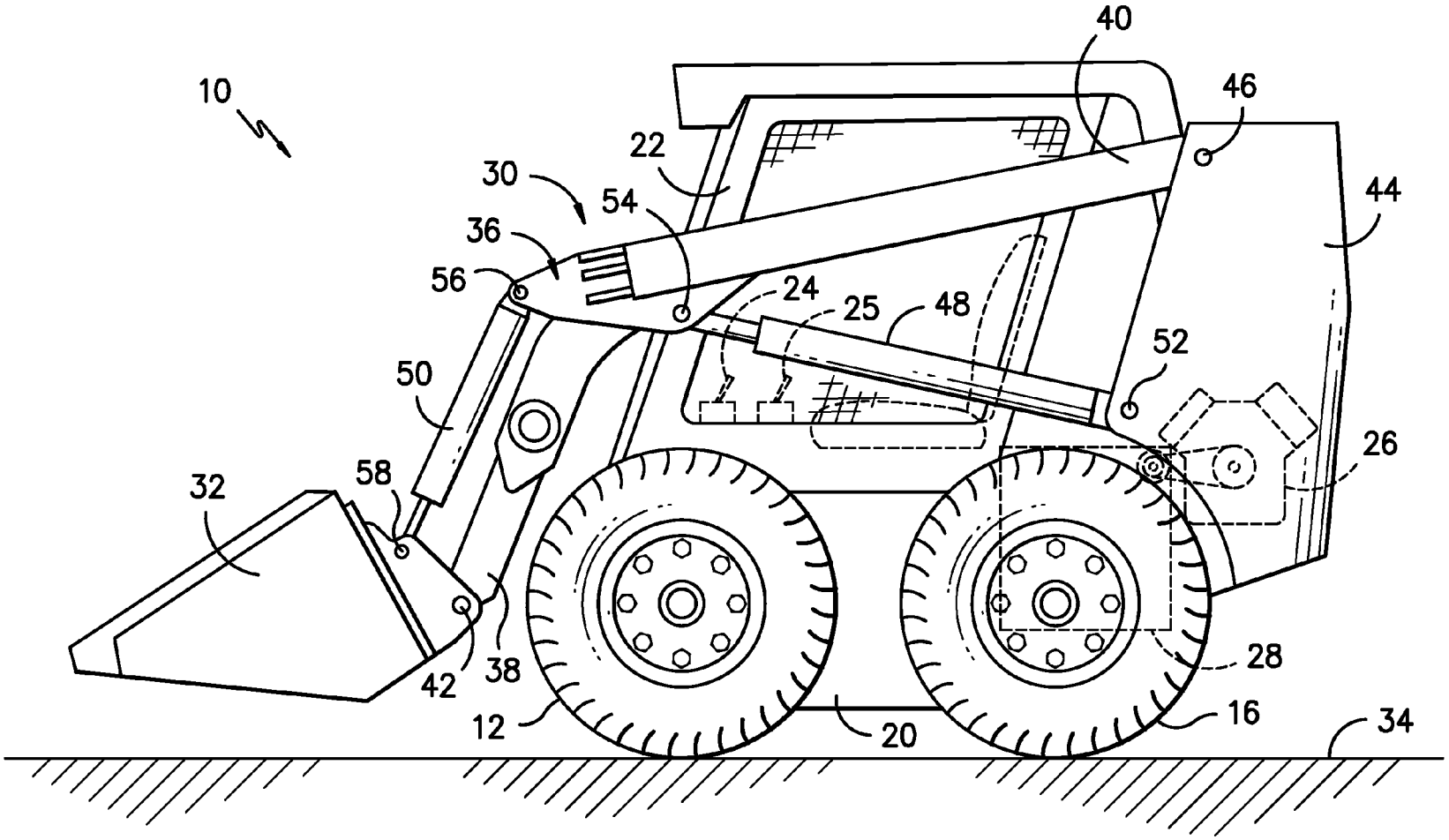
FIG. 1 illustrates a side view of one embodiment of a work vehicle.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to systems and methods for automatically adjusting the position of an implement of a work vehicle in order to maintain the implement at a fixed or constant angular orientation relative to a given reference point as the vehicle's loaders arms are being raised or lowered. In several embodiments, such control of the position of the implement may be achieved using a closed-loop control algorithm that employs a combination of both feed-forward and feedback control. Specifically, as will be described below, the feed-forward control portion of the closed-loop control algorithm may be configured to utilize a flow-related parameter of the work vehicle and, optionally, one or more secondary input signals (e.g., the loader position and/or the loader geometry) to generate a first output signal for adjusting the position of the implement. Such input signal(s) may allow for the feed-forward control to reduce system delays, thereby increasing the system's overall responsiveness. In addition, the feedback control portion of the closed-loop control algorithm may be configured to utilize an error signal based on the difference between the desired position and the actual position of the implement to generate a second output signal that takes into account certain variables that may not otherwise be accounted for by the feed-forward control, thereby allowing for improved accuracy with respective to controlling the position of the implement. The first and second control signals generated by the feed-forward and feedback control terms may then be combined to generate a final control command for controlling the movement of the implement as the loader arms are being raised or lowered. For instance, the final control command may correspond to a valve control command that is transmitted to the valve(s) controlling the supply of hydraulic fluid to the cylinder(s) associated with the implement, in such instance, the operation of the valve(s) may be controlled such that the cylinder(s) adjusts the position of the implement in a manner that maintains the implement at the desired angular orientation relative to the vehicle's driving surface (or relative to any other suitable reference point).

Referring now to the drawings, FIG. 1 illustrates a side view of one embodiment of a work vehicle 10 in accordance with aspects of the present subject matter. As shown, the work vehicle 10 is configured as a skid steer loader. However, in other embodiments, the work vehicle 10 may be configured as any other suitable work vehicle known in the art, such as any other vehicle including a lift assembly that allows for the maneuvering of an implement (e.g., telescopic handlers, wheel loaders, backhoe loaders, forklifts, compact track loaders, bulldozers and/or the like).

As shown, the work vehicle 10 includes a pair of front wheels 12, (one of which is shown), a pair of rear wheels 16 (one of which is shown) and a Chassis 20 coupled to and supported by the wheels 12, 16. An operator's cab 22 may be supported by a portion of the chassis 20 and may house various input devices, such as one or more speed control joysticks 24 and one or more lift/tilt joysticks 25, for permitting an operator to control the operation of the work vehicle 10. In addition, the work vehicle 10 may include an engine 26 and a hydrostatic drive unit 28 coupled to or otherwise supported by the chassis 20.

Moreover, as shown in FIG. 1, the work vehicle 10 may also include a lift assembly 30 for raising and lowering a suitable implement 32 (e.g., a bucket) relative to a driving surface 34 of the vehicle 10. In several embodiments, the lift assembly 30 may include a pair of loader arms 36 (one of which is shown) pivotally coupled between the chassis 20 and the implement 32. For example, as shown in FIG. 1, each loader arm 36 may be configured to extend lengthwise between a forward end 38 and an aft end 40, with the forward end 38 being pivotally coupled to the implement 32 at a forward pivot point 42 and the aft end 40 being pivotally coupled to the chassis 20 (or a rear tower(s) 44 coupled to or otherwise supported by the chassis 20) at a rear pivot point 46.

In addition, the lift assembly 30 may also include a pair of hydraulic lift cylinders 48 coupled between the chassis 20 (e.g., at the rear tower(s) 44) and the loader arms 36 and a pair of hydraulic tilt cylinders 50 coupled between the loader arms 36 and the implement 32. For example, as shown in the illustrated embodiment, each lift cylinder 48 may be pivotally coupled to the chassis 20 at a lift pivot point 52 and may extend outwardly therefrom so to be coupled to its corresponding loader arm 36 at an intermediate attachment location 54 defined between the forward and aft ends 38, 40 of each loader arm 36. Similarly, each tilt cylinder 50 may be coupled to its corresponding loader arm 36 at a first attachment location 56 and may extend outwardly therefrom so as to be coupled to the implement 32 at a second attachment location 58.

It should be readily understood by those of ordinary skill in the art that the lift and tilt cylinders 48, 50 may be utilized to allow the implement 32 to be raised/lowered and/or pivoted relative to the driving surface 34 of the work vehicle 10. For example, the lift cylinders 48 may be extended and retracted in order to pivot the loader arms 36 upward and downwards, respectively, about the rear pivot point 52, thereby at least partially controlling the vertical positioning of the implement 32 relative to the driving surface 34. Similarly, the tilt cylinders 50 may be extended and retracted in order to pivot the implement 32 relative to the loader arms 36 about the forward pivot point 42, thereby controlling the tilt angle or orientation of the implement 32 relative to the driving surface 34. As will be described below, by automatically controlling the operation of the tilt cylinders 50 (e.g., via their associated valve(s)) based on the closed-loop control algorithm disclosed herein, the orientation or angle of the implement 32 relative to the driving surface 34 (or relative to any other suitable reference point) may be maintained constant as the loader arms are being moved in response to operator-initiated inputs. Accordingly, if the operator desires for the implement 32 to be maintained at a 5° angle relative to the vehicle's driving surface 34 (or at any other suitable angle), the actuation of the tilt cylinders 50 may be automatically controlled such that the desired angular orientation is maintained as the loader arms 36 are pivoted about the rear pivot point 46.

It should be appreciated that the configuration of the work vehicle 10 described above and shown in FIG. 1 is provided only to place the present subject matter in an exemplary field of use. Thus, it should be appreciated that the present subject matter may be readily adaptable to any manner of work vehicle configuration.

Figure 2:
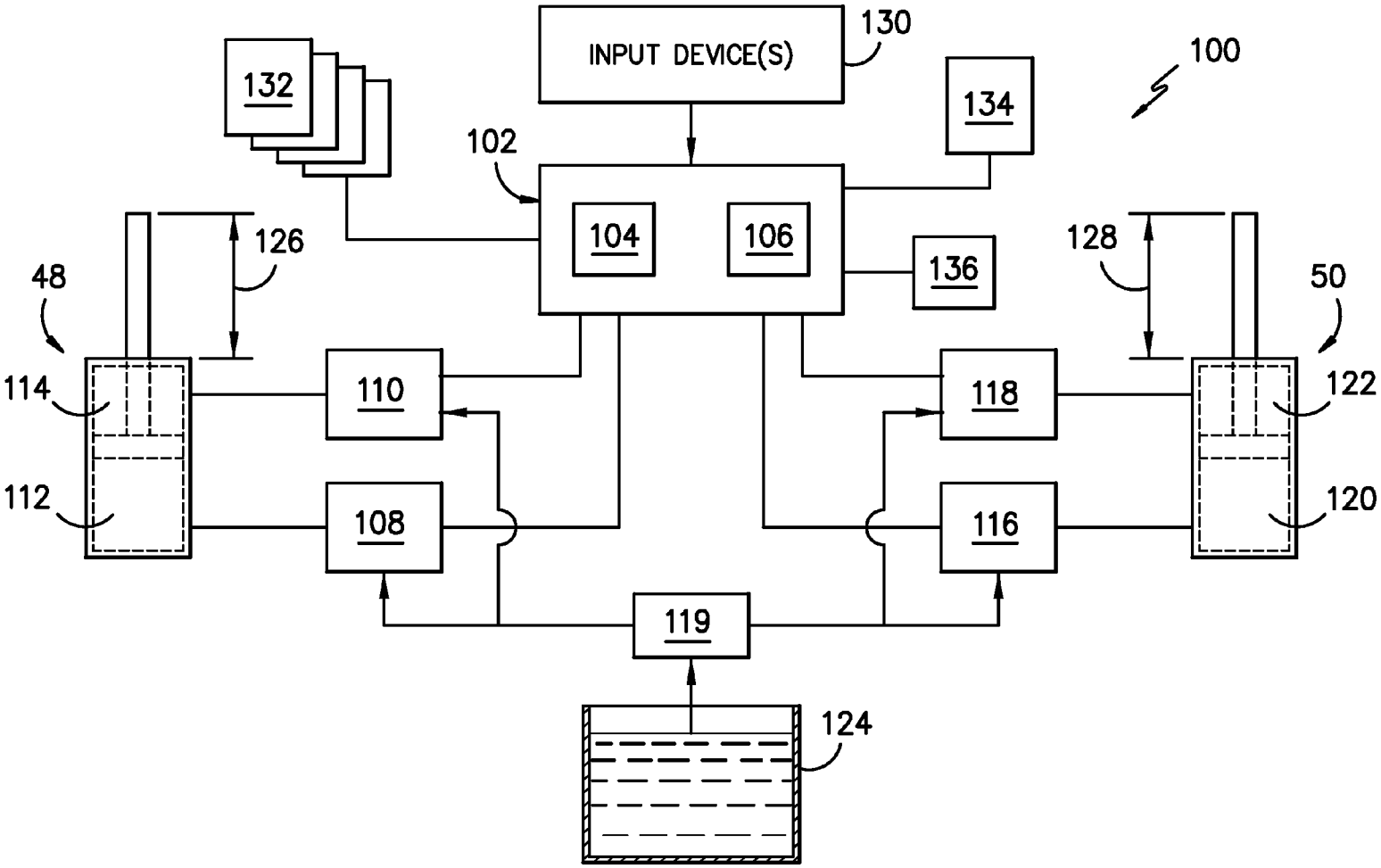
FIG. 2 illustrates a schematic view of one embodiment of a suitable control system for controlling various components of a work vehicle in accordance with aspects of the present subject matter, particularly illustrating the control system configured for controlling various hydraulic components of the work vehicle, such as the hydraulic cylinders of the work vehicle.

Referring now to FIG. 2, one embodiment of a control system 100 suitable for automatically controlling the various lift assembly components of a work vehicle is illustrated in accordance with aspects of the present subject matter. In general, the control system 100 will be described herein with reference to the work vehicle 10 described above with reference to FIG. 1. However, it should be appreciated by those of ordinary skill in the art that the disclosed system 100 may generally be utilized to the control the lift assembly components of any suitable work vehicle.

As shown, the control system 100 may generally include a controller 102 configured to electronically control the operation of one or more components of the work vehicle 10, such as the various hydraulic components of the work vehicle 10 (e.g., the lift cylinders 48 and/or the tilt cylinders 50). In general, the controller 102 may comprise any suitable processor-based device known in the art, such as a computing device or any suitable combination of computing devices. Thus, in several embodiments, the controller 102 may include one or more processor(s) 104 and associated memory device(s) 106 configured to perform a variety of computer implemented functions. As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory device(s) 106 of the controller 102 may generally comprise memory element(s) including, but are not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory device(s) 106 may generally be configured to store suitable computer-readable instructions that, when implemented by the processor(s) 104, configure the controller 102 to perform various computer-implemented functions, such as the algorithms or methods described below with reference to FIGS. 3 and 4. In addition, the controller 102 may also include various other suitable components, such as a communications circuit or module, one or more input/output channels, a data/control bus and/or the like.

It should be appreciated that the controller 102 may correspond to an existing controller of the work vehicle 10 or the controller 102 may correspond to a separate processing device. For instance, in one embodiment, the controller 102 may form all or part of a separate plug-in module that may be installed within the work vehicle 10 to allow for the disclosed system and method to be implemented without requiring additional software to be uploaded onto existing control devices of the vehicle 10.

In several embodiments, the controller 102 may be configured to be coupled to suitable components for controlling the operation of the various cylinders 48, 50 of the work vehicle 10. For example, the controller 102 may be communicatively coupled to suitable valves 108, 110 (e.g., solenoid-activated valves) configured to control the supply of hydraulic fluid to each lift cylinder 48 (only one of which is shown in FIG. 2). Specifically, as shown in the illustrated embodiment, the system 100 may include a first lift valve 108 for regulating the supply of hydraulic fluid to a cap end 112 of each lift cylinder 48. In addition, the system 100 may include a second lift valve 110 for regulating the supply of hydraulic fluid to a rod end 114 of each lift cylinder 48. Moreover, the controller 102 may be communicatively coupled to suitable valves 116, 118 (e.g., solenoid-activated valves) configured to regulate the supply of hydraulic fluid to each tat cylinder 50 (only one of which is shown in FIG. 2). For example, as shown in the illustrated embodiment, the system 100 may include a first tilt valve 116 for regulating the supply of hydraulic fluid to a cap end 120 of each tilt cylinder 50 and a second tilt valve 118 for regulating the supply of hydraulic fluid to a rod end 122 of each tilt cylinder 50.

During operation, the controller 102 may be configured to control the operation of each valve 108, 110, 116, 118 in order to control the flow of hydraulic fluid supplied to each of the cylinders 48, 50 from a suitable hydraulic tank 124 of the work vehicle 10 (e.g., via a hydraulic pump 119, such as a fixed displacement pump or a variable displacement hydraulic pump). For instance, the controller 102 may be configured to transmit suitable control commands to the lift valves 108, 110 in order to regulate the flow of hydraulic fluid supplied to the cap and rod ends 112, 114 of each lift cylinder 48, thereby allowing for control of a stroke length 126 of the piston rod associated with each cylinder 48. Of course, similar control commands may be transmitted from the controller 102 to the tilt valves 116, 118 in order to control a stroke length 128 of the tilt cylinders 50. Thus, by carefully controlling the actuation or stroke length 126, 128 of the lift and tilt cylinders 48, 50, the controller 102 may, in turn, be configured to automatically control the manner in which the loader arms 36 and the implement 32 are positioned or oriented relative to the vehicle's driving surface 34 and/or relative to any other suitable reference point.

It should be appreciated that the current commands provided by the controller 102 to the various valves 108, 110, 116, 118 may be in response to inputs provided by the operator via one or more input devices 130. For example, one or more input devices 130 (e.g., the lift/tilt joystick(s) 25 shown in FIG. 1) may be provided within the cab 22 to allow the operator to provide operator inputs associated with controlling the position of the loader arms 36 and the implement 32 relative to the vehicle's driving surface 34 (e.g., by varying the current commands supplied to the lift and/or tilt valves 108, 110, 116, 118 based on operator-initiated changes in the position of the lift/tilt joystick(s) 25). Alternatively, the current commands provided to the various valves 108, 110, 116, 118 may be generated automatically based on a control algorithm implemented by the controller 102. For instance, as will be described in detail below, the controller 102 may be configured to implement a closed-loop control algorithm for automatically controlling the angular orientation of the implement 32. In such instance, output signals or control commands generated by the controller 102 when implementing the closed-loop control algorithm may be automatically transmitted to the tilt valve(s) 116, 118 to provide for precision control of the angular orientation/position of the implement 32.

Additionally, it should be appreciated that the work vehicle 10 may also include any other suitable input devices 130 for providing operator inputs to the controller 102. For instance, in accordance with aspects of the present subject matter, the operator may be allowed to select/input an angular orientation for the implement 32 that is to be maintained as the loader arms 36 are being moved. In such instance, the desired orientation may be selected or input by the operator using any suitable means that allows for the communication of such orientation to the controller 102. For example, the operator may be provided with a suitable input device(s) 130 (e.g., a button(s), touch screen, lever(s), etc.) that allows the operator to select/input particular angle at which the implement 32 is to be maintained during movement of the loader arms 36, such as a specified angle defined relative to the vehicle's driving surface 34. In addition, or as an alternative thereto, the operator may be provided with a suitable input device(s) 130 (e.g., a button(s), touch screen, lever(s), etc.) that allows the operator to record or select the current angular orientation of the implement 32 as the desired orientation, which may then be stored within the controller's memory 106. Moreover, in one embodiment, one or more pre-defined implement orientation/position settings may be stored within the controller's memory 106. In such an embodiment, the operator may simply select one of the pre-defined orientation/position settings in order to instruct the controller 102 as to the desired orientation for the implement 32.

Moreover, as shown in FIG. 2, the controller 102 may also be communicatively coupled to one or more position sensors 132 for monitoring the position(s) and/or orientation(s) of the loader arms 36 and/or the implement 32. In several embodiments, the position sensor(s) 132 may correspond to one or more angle sensors (e.g., a rotary or shaft encoder(s) or any other suitable angle transducer) configured to monitor the angle or orientation of the loader arms 36 and/or implement 32 relative to one or more reference points. For instance, in one embodiment, an angle sensor(s) may be positioned at the forward pivot point 42 (FIG. 1) to allow the angle of the implement 32 relative to the loader arms 36 to be monitored. Similarly, an angle sensor(s) may be positioned at the rear pivot point 46 to allow the angle of the loader arms 36 relative to a given reference point on the work vehicle 10 to be monitored. In addition to such angle sensor(s), or as an alternative thereto, one or more secondary angle sensors (e.g., a gyroscope, inertial sensor, etc.) may be mounted to the loader arms 36 and/or the implement 32 to allow the orientation of such component(s) relative to the vehicle's driving surface 34 to be monitored.

In other embodiments, the position sensor(s) 132 may correspond to any other suitable sensor(s) that is configured to provide a measurement signal associated with the position and/or orientation of the loader arms 36 and/or the implement 32. For instance, the position sensor(s) 132 may correspond to one or more linear position sensors and/or encoders associated with and/or coupled to the piston rod(s) or other movable components of the cylinders 48, 50 in order to monitor the travel distance of such components, thereby allowing for the position of the loader arms 36 and/or the implement 32 to be calculated. Alternatively, the position sensor(s) 132 may correspond to one or more non-contact sensors, such as one or more proximity sensors, configured to monitor the change in position of such movable components of the cylinders 48, 50. In another embodiment, the position sensor(s) 132 may correspond to one or more flow sensors configured to monitor the fluid into and/or out of each cylinder 48, 50, thereby providing an indication of the degree of actuation of such cylinders 48, 50 and, thus, the location of the corresponding loader arms 36 and/or implement 32. In a farther embodiment, the position sensor(s) 132 may correspond to a transmitter(s) configured to be coupled to a portion of one or both of the loader arms 36 and/or the implement 32 that transmits a signal indicative of the height/position and/or orientation of the loader arms/implement 36, 32 to a receiver disposed at another location on the vehicle 10.

It should be appreciated that, although the various sensor types were described above individually, the work vehicle 10 may be equipped with any combination of position sensors 132 and/or any associated sensors that allow for the position and/or orientation of the loader arms 36 and/or the implement 32 to be accurately monitored. For instance, in one embodiment, the work vehicle 10 may include both a first set of position sensors 132 (e.g., angle sensors) associated with the pins located at the pivot joints defined at the forward and rear pivot points 42, 46 for monitoring the relative angular positions of the loader arms 36 and the implement 32 and a second set of position sensors 132 (e.g., a linear position sensor(s), flow sensor(s), etc.) associated with the lift and tilt cylinders 48, 50 for monitoring the actuation of such cylinders 48, 50.

Additionally, it should be appreciated that the controller 102 may also be coupled to various other sensors for monitoring one or more other operating parameters of the work vehicle 10. For instance, as shown in FIG. 2, the controller 102 may be coupled to one or more engine speed sensors 134 configured to monitor the speed of the vehicle's engine 26 (e.g., in RPMs). In such an embodiment, the engine speed sensor(s) 134 may generally correspond to any suitable sensor(s) that allow for the engine speed to be monitored and communicated to the controller 102, For example, the engine speed sensor(s) 134 may correspond to an internal speed sensor(s) of an engine governor (not shown) associated with the engine 26. Alternatively, the engine speed sensor(s) 134 may correspond to any other suitable speed sensor(s), such as a shaft sensor, configured to directly or indirectly monitor the engine speed. In another embodiment, the engine speed sensor(s) 134 may be configured to monitor the rotational speed of the engine 26 by detecting fluctuations in the electric output of an engine alternator (not shown) of the work vehicle 10, which may then be correlated to the engine speed.

Moreover, as shown in FIG. 2, the controller 102 may also be coupled to one or more fluid-related sensors 146 configured to monitor one or more flow-related parameters of the work vehicle 10. For instance, in several embodiments, the fluid-related sensor(s) 146 may correspond to one or more pressure sensors for monitoring the pressure of the hydraulic fluid supplied to and/or within the lift and/or tilt cylinders 48, 50. Specifically, in one embodiment, the system 100 may include a plurality of pressure sensors to allow the pressure of the hydraulic fluid supplied to both rod and cap ends 112, 114, 120, 122 of each of the various hydraulic cylinders 48, 50 of the lift assembly 30 to be monitored. It should also be appreciated that the flow rate of the hydraulic fluid supplied to and/or within the lift and/or tilt cylinders 48, 50 may be determined based on the signal(s) provided by the pressure sensor(s) together with the open area of the corresponding valve(s) 108, 110, 116, 118, with such open area being determined based on the joystick command provided by the operator and/or measured via a suitable sensor(s). In other embodiments, it should be appreciated that the fluid-related sensor(s) 146 may correspond to any other suitable sensor(s) that allows one or more flow-related parameters of the work vehicle 10 to be directly or indirectly monitored, such as one or more flow sensors configured to monitor the flow rate of the hydraulic fluid supplied to and/or within the lift and/or tilt cylinders 48, 50, one or more pump sensors configured to monitor one or more parameters related to the operation of the pump 119 (e.g., the displacement of the pump 119 and/or the input speed for the pump 119), one or more engine speed sensors (e.g., sensor(s) 134) configured to monitor the engine speed and/or one or more position and/or velocity sensors (e.g., sensor(s) 132) configured to monitor the change in position of the loader arms 36 and/or the implement 32.

Figure 3:
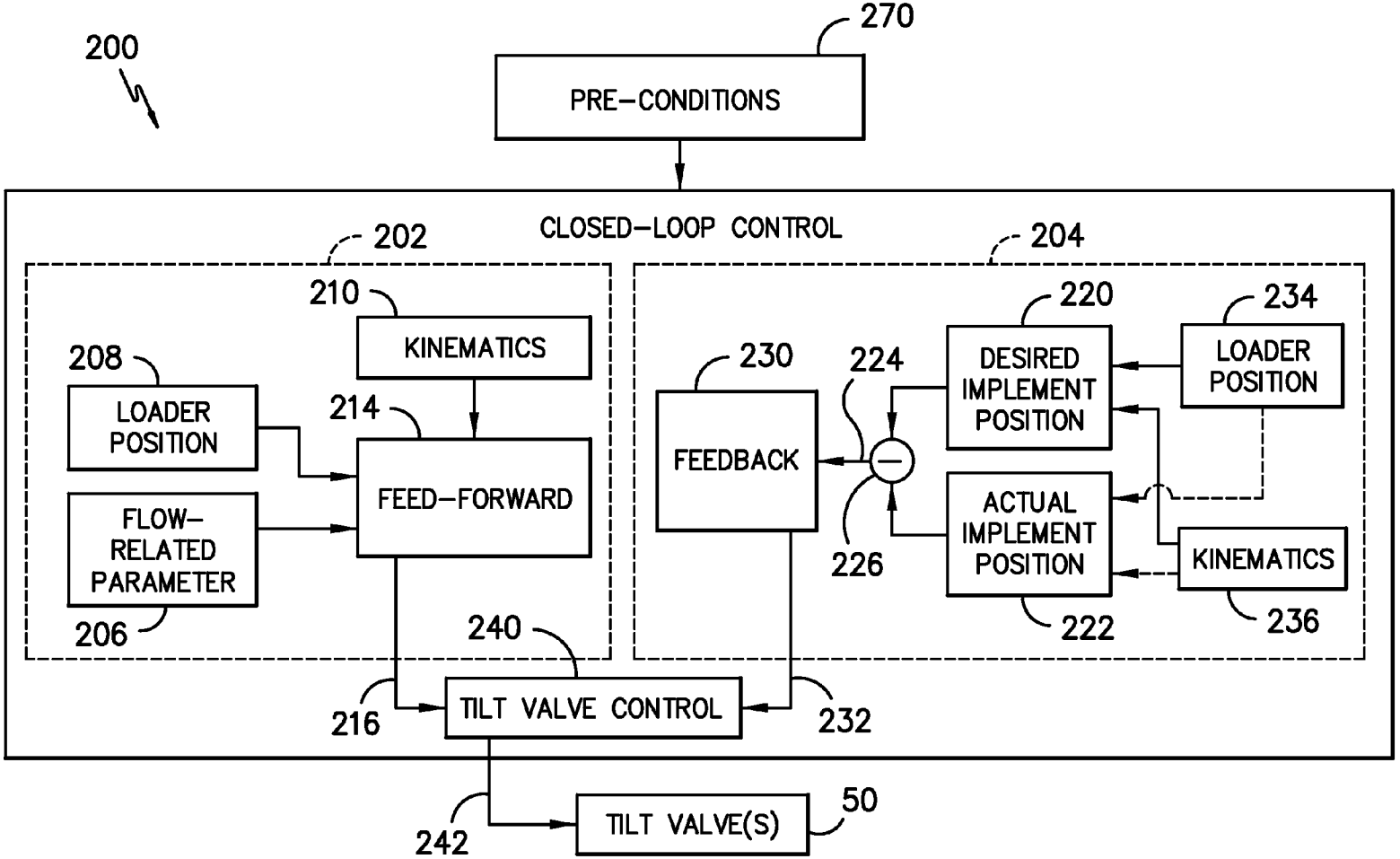
FIG. 3 illustrates a flow diagram of one embodiment of a closed-loop control algorithm that may be utilized by the control system shown in FIG. 2 in order to maintain an implement of a work vehicle at a constant angular orientation as the vehicle's loader arms are being moved in accordance with aspects of the present subject matter.

Referring now to FIG. 3, a flow diagram of one embodiment of a closed-loop control algorithm 200 that may be implemented by the controller 102 for maintaining a constant angular orientation of an implement 32 is illustrated in accordance with aspects of the present subject matter. Specifically, in several embodiments, the disclosed control algorithm 200 may provide the work vehicle 10 with self-leveling functionality for the implement 32, thereby allowing the angular orientation of the implement 32 relative to the vehicle's driving surface 34 (or relative to any other suitable reference point) to be maintained constant as the loader arms 36 are being moved along their range of travel. For instance, the controller 102 may be configured to initially learn a desired angular orientation for the implement 32, such as by receiving an input from the operator (e.g., via a suitable input device 130) corresponding to the angle at which the implement 32 is to be maintained relative to the vehicle's driving surface 34. The controller 102 may then implement the closed-loop control algorithm 200 to allow control signals to be generated for controlling the operation of the vehicle's tilt valve(s) 116, 118 in a manner that maintains the implement 32 at the desired angular orientation as the loader arms 36 are rotated clockwise or counter-clockwise about the rear pivot point 46.

In several embodiments, the closed-loop control algorithm 200 may employ both a feed-forward control portion (indicated by dashed box 202 in FIG. 3) and a feedback control portion (indicated by dashed box 204 in FIG. 3). The feed-forward control 202 may generally allow for the control algorithm 200 to reduce delays within the system, thereby increasing the system's responsiveness in relation to controlling the tilt valves 116, 118 and the corresponding tilt cylinders 50 of the vehicle's lift assembly 30, which, in turn, allows for more precise and accurate control of the implement's orientation/position. In addition, the feedback control 204 may allow for error-based adjustments to be made to the control signals generated by the controller 102 that take into account variables not accounted for by the feed-forward control 202 (e.g., how loading and/or other variables may impact the responsiveness and/or effectiveness of the position control for the implement 32).

In several embodiments, the feed-forward control portion 202 of the disclosed algorithm 200 may be configured to receive one or more input signals, such as a flow-related parameter signal 206. In general, the flow-related parameter signal 206 may correspond to any suitable parameter(s) that provides an indication of and/or is associated with the flow of hydraulic fluid being supplied to and/or within the lift and/or tilt cylinders 48, 50. For example, in several embodiments, the flow-related parameter signal 206 may be based on the sensor measurements provided by the fluid related sensor(s) 136 described above with reference to FIG. 2. Specifically, as indicated above, the fluid-related sensor(s) 136 may be configured to monitor a flow-related parameter of the work vehicle 10, such as the fluid pressure and/or the flow rate of the hydraulic fluid being supplied to and/or within the lift and/or tilt cylinders 48, 50 and/or one or more parameters associated with the pump 119.

In other embodiments, the flow-related parameter signal 206 may derive from and/or corresponds to one or more other input signals and/or monitored parameters that are associated with the flow of hydraulic fluid being supplied to and/or within the lift and/or tilt cylinders 48, 50. For instance, as is generally understood, the angular velocity of the loader arms 36 and/or the implement 32 may be directly related to the flow of hydraulic fluid being supplied to and/or within the lift and/or tilt cylinders 48, 50. Thus, in one embodiment, the flow-related parameter signal 206 may be determined as a function of and/or may correspond to the angular velocity of the loader arms 36 and/or the implement 32. It should be appreciated that the angular velocity may be monitored using any suitable speed sensor(s) configured to directly monitor the velocity of the loader arms 36 and/or implement 32 and/or using any other suitable sensor(s) that allows for such velocity to be indirectly monitored. For instance, as indicated above, the controller 102 may be communicatively coupled to one or more position sensors 132 for monitoring the position of the loader arms 36 and/or the implement 32. In such instance, by monitoring the change in position of such component(s) over time, the angular velocity may be estimated or calculated. For example, if the position sensor(s) 132 provides measurement signals corresponding to the position of the loader arms 36 at a given sampling frequency (e.g., every 100 milliseconds), the angular velocity of the loader arms 36 may be calculated by determining the change in position of the loader arms 36 between the last two position measurements and by dividing the difference by the time interval existing between such measurements.

In a further embodiment, the flow-related parameter signal 206 may derive from and/or correspond to any other suitable input signal(s)/parameter(s) that is associated with the flow of hydraulic fluid being supplied to and/or within the lift and/or tilt cylinders 48, 50, such as the joystick command provided by the operator and/or the engine speed of the work vehicle 10. For instance, as indicated above, the operator may be allowed to provide inputs (e.g., via the lift/tilt joystick(s) 25 or using any other suitable input device(s) 130) for controlling the movement of the loader arms 36 and/or the implement 32. As a result, such operator-initiated inputs may provide an indication of and/or may otherwise be associated with the flow of hydraulic fluid being supplied, to and/or within the lift and/or tilt cylinders 48, 50. For instance, in one embodiment, the joystick command provided by the operator, together with the input speed and the displacement of the pump 119, may be utilized to calculate the angular velocity of the loader arms 36. Additionally, in embodiments in which the pump 119 corresponds to a variable displacement pump, the angular velocity of the loader arms 36 may be calculated based solely on the input speed of the pump 119 and the corresponding angle of the pump's swash plate. Moreover, the rotational or operational speed of the engine 26 may also provide an indication of and/or may otherwise be associated with the flow of hydraulic fluid being supplied to and/or within the lift and/or tilt cylinders 48, 50. As indicated above, the controller 102 may be communicatively coupled to one or more engine speed sensors 134 for monitoring the engine speed. In such an embodiment, the flow-related parameter signal 206 may be based directly (or indirectly) on the measurement signals provided by the engine speed sensor(s) 134.

Referring still to FIG. 3, in addition to the flow-related parameter signal, the feed-forward control portion 202 of the closed-loop control algorithm 200 may also utilize or receive various other signals and/or information, such as a loader position signal 208 and a kinematics signal 210. The loader position signal 208 may generally correspond to an input signal associated with the current position of the loader arms 36. As indicated above, the position of the loader arms 36 may be monitored, for example, using the position sensor(s) 132 of the disclosed system 100. Additionally, the kinematics signal 210 may generally correspond to information or data related to the loader geometry, such as specific information related to the length of the loader arms 32 (and/or the length of each section of the loader arms 32), the shape of the loader arms 36 (e.g., the relative angular orientations of the different straight sections of the loader arms 32) and/or other relevant information that allows the position of the loader arms 36 to be correlated to the position of the implement 32.

As shown in FIG. 3, the various signals 206, 208, 210 related to the feed-forward control 202 may be input into a feed-forward block 214 in order to generate a feed-forward output signal 216. In general, the feed-forward output signal 216 may correspond to a speed control signal that, based on the various input signals 206, 208 210, is associated with a calculated rate of change or speed at which the implement 32 needs to be moved in order to maintain the implement 32 at the desired angular orientation relative to the vehicle's driving surface 34 (or other reference point) as the loader arms 36 are being moved. Specifically, in several embodiments, the feed forward block 214 may utilized the input signals 206, 208, 210 to calculate a correlation or otherwise establish a relationship between the angular velocity of the loader arms 36 and the angular velocity of the implement 32. In such embodiments, by knowing or calculating the angular velocity of the loader arms 36 based on the flow-related parameter signal(s) 206, the speed control signal corresponding to the feed-forward output signal 216 may be calculated based on the established relationship between the angular velocity of the loader arms 36 and the angular velocity of the implement 32.

Referring still to FIG. 3, as indicated above, the closed-loop control algorithm 200 may also include a feedback control portion 204 that allows for error-based adjustments to be made to the feed-forward output signal 216. Specifically, in several embodiments, the feedback control 204 may be configured to determine the error between the actual and desired positions for the implement 32, which may then be used to adjust the calculated implement speed associated with the feed-forward output signal 216. Thus, as shown in FIG. 3, the feedback control portion 204 may be configured to receive two input signals, namely a desired implement position signal 220 and an actual implement position signal 222, and, based on such input signals 220, 222, generate a corresponding difference or error signal 224 via the difference block 226). The error signal 224 may then be input into a feedback function block 230 to generate a feedback output signal 232 that may serve as an adjustment or correction factor for modifying the feed-forward output signal 216. For instance, the feedback output signal 232 may correspond to a speed correction factor that may be used to modify the implement speed associated with the feed-forward output signal 216.

It should be appreciated that the desired implement position signal 220 may generally correspond to the specific position at which the implement 32 must be located based on the current position of the loader arms 36 in order to maintain the implement 32 at the desired angular orientation. Specifically, given the geometry and the mechanics of the lift assembly 30, the position of the implement 32 must be adjusted constantly as the position of the loader arms 36 is changed in order to maintain the desired angular orientation. Thus, as shown in FIG. 3, the desired implement position 220 may, in several embodiments, be determined based on a monitored loader position signal 234 (e.g., derived from the position sensor(s) 132 used to monitor the position of the loader arms 36) and/or a kinematics signal 236 associated with the geometry of the loader arms 36. In such embodiments, the current loader arm position associated with the input signal 234 may, for example, be used within a suitable algorithm or data table (e.g., a look-up table) that takes into account the loader geometry in order to determine the corresponding implement position required to maintain the desired angular orientation of the implement 32. The resulting desired implement position 224 may then be compared to the actual implement position 226 (e.g., via the difference block 226) in order to generate the position error signal 224 and subsequently the resulting feedback output signal 232.

It should also be appreciated that the actual implement position signal 222 may, in several embodiments, generally derive from any suitable sensor(s) configured to monitor the position of the implement 32 relative to a known reference point. For instance, as indicated above, the controller 102 may be communicatively coupled to one or more position sensors 132 for monitoring the implement's position. In such an embodiment, the actual implement position signal 222 may be based directly (or indirectly) on the measurement signals provided by the position sensor(s) 132. Alternatively, the actual implement position signal 222 may be calculated based on one or more input signals. For instance, as shown in dashed lines in FIG. 3, the actual implement position signal 222 may, in one embodiment, be modified based on inputs related to the current loader position (e.g., signal 234) and/or the loader geometry (e.g., signal 236).

Referring still to FIG. 3, the output signals 216, 232 generated by the feed-forward and feedback control portions 202, 204 may then be input into a tilt valve control block 240 configured to generate a valve control command 242 for controlling the operation of the tilt valve(s) 50. Specifically, in several embodiments, the calculated implement speed associated with the feed-forward output signal 216 may be adjusted based on the calculated speed correction factor associated with the feedback output signal 232 so as to produce a final adjusted speed for the implement 32. Thereafter, the adjusted speed value may be converted into a suitable valve control command 242 that may be transmitted to the tilt valve(s) 50 in order to control the operation of the valve(s) 50 in a manner that causes the implement 32 to be maintained at the desired angular orientation relative to the vehicle's driving surface 34 (or relative to any other reference point) as the loader arms 36 are being moved along their range of travel.

It should be appreciated that the feed-forward and feedback output signals 216, 232 may be combined or otherwise processed in any suitable manner in order to generate the final valve control command(s) 242. For instance, in one embodiment, one of the signals may be used as a multiplier or modifier to adjust the other signal. In another embodiment, the feed-forward and feedback output signals 216, 232 may simply be summed to generate the final valve control command(s) 242.

Additionally, it should be appreciated that the feed-forward and feedback output signals 216, 232 may also be utilized to generate the final valve control command(s) 242 by predicting a future loader position for the loader arms 36 based on such signal(s), which may then be used to calculate the final valve control command(s) 242. In such instance, the future loader position for the loader arms 36 may generally correspond to an estimated or predicted position to which it is believed that the loader arms 36 will be moved at some point in the future (e.g., at time (Δt)) based on the adjusted implemented speed calculated using the feed-forward and feedback output signals 216, 232. Such predicted loader position may then be utilized to generate the appropriate valve command signal(s) 242.

Figure 4:
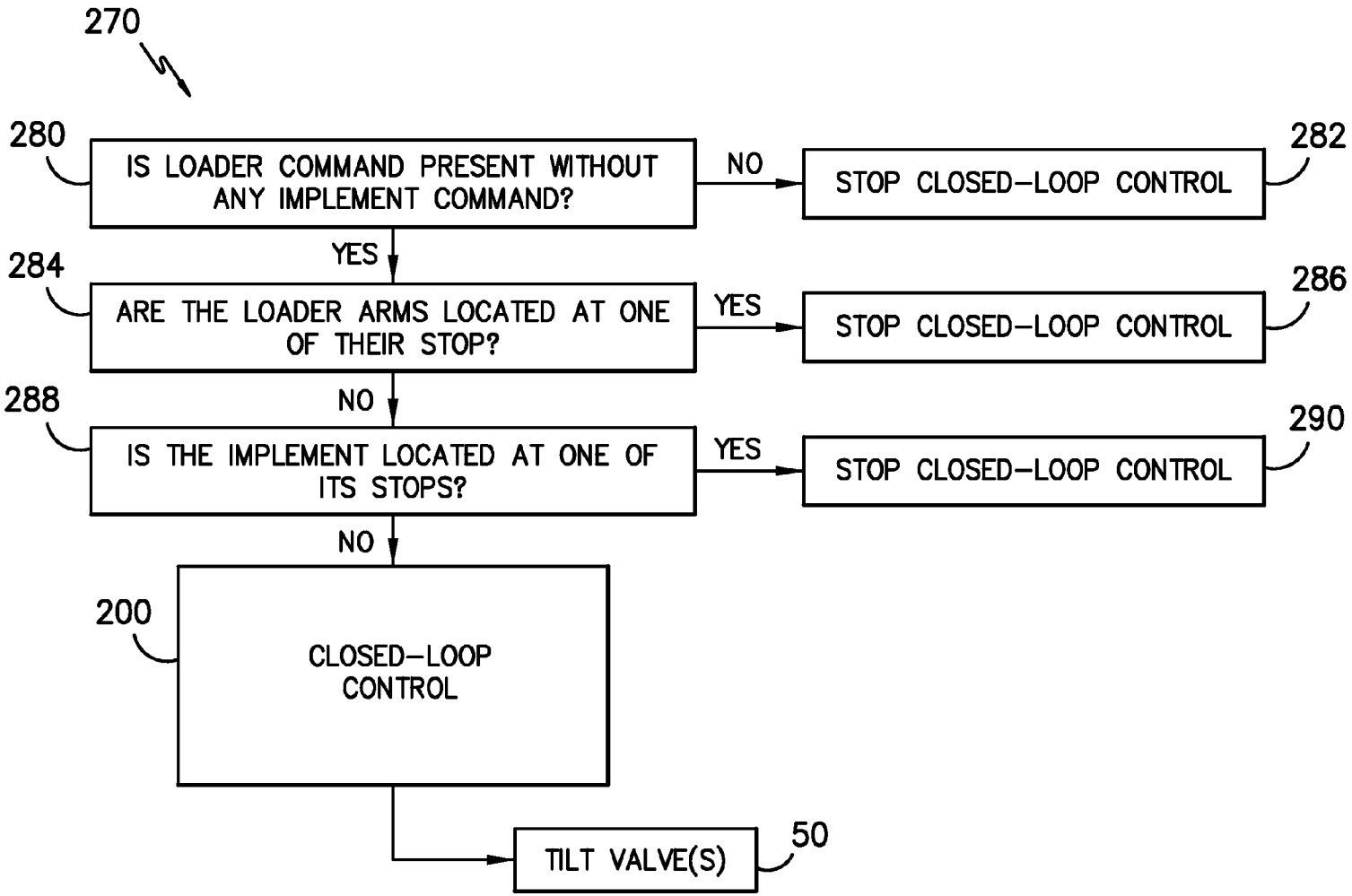
FIG. 4 illustrates a flow diagram including various preconditions that may be considered when implementing the closed-loop control algorithm shown in FIG. 3 in accordance with aspects of the present subject matter.

Moreover, in several embodiments, the controller 102 may be configured to determine if one or more pre-conditions 270 are satisfied prior to implementing (or continuing to implement) the closed-loop control algorithm 200. For instance, FIG. 4 illustrates a flow diagram including various pre-conditions 270 that may be considered by the controller 102 prior to implementing (or continuing to implement) the closed-loop control algorithm 200. As shown in FIG. 4, the controller 102 may be configured to verify (at box 280) that a loader command(s) is currently being received for moving the loader arms 36 while also verifying that the operator is not simultaneously commanding movement of the implement 32. If the loader arms 36 are not being commanded to be moved and/or if the implement 26 is being commanded to be moved by the operator (e.g., via the lift/tilt lever 25), the controller 102 may be configured to stop implementation of the closed-loop algorithm 200 (e.g., at box 282). However, if the opposite is true, the controller 102 may be configured to determine whether a second pre-condition is satisfied (at box 284), namely whether the loader arms 36 are positioned at the mechanical stop(s) located at either end of the range of travel of the loader arms 36. If the loader arms 36 are located at one of their stops, the controller 102 may be configured to stop implementation of the closed-loop algorithm 200 (e.g., at box 286). However, if the loader arms 36 are located at a position between the stops, the controller 102 may be configured to determine whether a third pre-condition is satisfied (at box 288), namely whether the implement 32 is positioned at the mechanical stop(s) located at either end of its range of travel. If the implement 32 is located at one of its stops, the controller 102 may be configured to stop implementation of the closed-loop algorithm 200 (e.g., at box 290). However, if the implement 32 is located at a position between its stops, the controller 102 may initiate implementation (or continue implementation) of the closed-loop algorithm 200.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for automatically adjusting the position of an implement of a lift assembly for a work vehicle, the lift assembly comprising a loader arm coupled to the implement, the method comprising:

monitoring, with a computing device, at least one of a fluid pressure or a flow rate of hydraulic fluid supplied to or within a cylinder for controlling the movement of the implement, as the loader arm is being moved;

determining, with the computing device, a speed control signal for the implement as a function of an angular velocity of the loader arms calculated using the at least one of the monitored fluid pressure or the monitored flow rate of the hydraulic fluid, the speed control signal being associated with an implement speed at which the implement is to be moved in order to maintain the implement at a fixed orientation relative to a given reference point:

generating, with the computing device, a valve command signal based at least in part on the speed control signal; and transmitting, with the computing device, the valve command signal to a valve associated with the implement in order to maintain the implement at the fixed orientation as the loader arm is are being moved.

2. The method of claim 1, further comprising receiving an operator input signal associated with a selection of the fixed orientation for the implement.

3. The method of claim 1, further comprising generating a second control signal based on the difference between a desired implement position and an actual implement position for the implement.

4. The method of claim 3, wherein generating the valve command signal based at least in part on the speed control signal comprises generating the valve command signal based on the speed control signal and the second control signal.

5. The method of claim 4, wherein the second control signal corresponds to a speed correction factor, further comprising adjusting the implement speed associated with the speed control signal based on the speed correction factor associated with the second speed control signal in order to generate an adjusted implement speed for maintaining the implement at the fixed orientation as the loader arm is being moved.

6. The method of claim 5, wherein the valve command signal is generated such that the valve is controlled in a manner so as to cause the implement to be moved at the adjusted implement speed.

7. The method of claim 3, further comprising:

monitoring a position of the loader arm as the loader arm is being moved; and determining the desired implement position based on at least one of the monitored position of the loader arm or a loader geometry associated with the loader arm.

8. The method of claim 1, wherein the reference point corresponds to a driving surface for the work vehicle.

9. The method of claim 1, further comprising monitoring a loader position of the loader arm as the loader arm is being moved.

10. The method of claim 9, wherein determining the speed control signal for the implement as a function of the at least one of the monitored fluid pressure or the monitored flow rate of the hydraulic fluid comprises determining the speed control signal as a function of the monitored loader position and the at least one of the monitored fluid pressure or the monitored flow rate of the hydraulic fluid.

11. The method of claim 10, wherein determining the speed control signal for the implement as a function of the at least one of the monitored fluid pressure or the monitored flow rate of the hydraulic fluid comprises determining the speed control signal as a function of the monitored loader position, the at least one of the monitored fluid pressure or the monitored flow rate of the hydraulic fluid, and kinematic information associated with a loader geometry of the loader arm.

12. A system for controlling the operation of a work vehicle, the system comprising:

a lift assembly including an Implement and a loader arm coupled to the implement;

a tilt valve in fluid communication with a corresponding tilt cylinder, the tilt valve being configured to control a supply of hydraulic fluid to the tilt cylinder in order to adjust the position of the implement relative to the loader arm; and a controller communicatively coupled to the tilt valve, the controller including at least one processor and associated memory, the memory storing instructions that, when implemented by the at least one processor, configure the controller to:

monitor at least one of a fluid pressure or a flow-rate of the hydraulic fluid supplied to or within the tilt cylinder as the loader arm is being moved;

determine a speed control signal for the implement as a function of an angular velocity of the loader arms calculated using the at least one of the monitored fluid pressure or the monitored flow rate of the hydraulic fluid, the speed control signal being associated with an implement speed at which the implement is to be moved in order to maintain the implement at a fixed orientation relative to a given reference point;

generate a valve command signal based at least in part on the speed control signal; and transmit the valve command signal to the tilt valve in order to maintain the implement at the fixed orientation as the loader arms is being moved.

13. The system of claim 12, wherein the controller is further configured to receive an operator input signal associated with a selection of the fixed orientation for the implement.

14. The system of claim 12, wherein the controller is further configured to generate a second control signal based on the difference between a desired implement position and an actual implement position for the implement.

15. The system of claim 14, wherein the controller is configured to generate the valve command signal based on the speed control signal and the second control signal.

16. The system of claim 14, wherein the second control signal corresponds to a speed correction factor, wherein the controller is configured to adjust the implement speed associated with the speed control signal based on the speed correction factor associated with the second speed control signal in order to generate an adjusted implement speed for maintaining the implement at the fixed orientation as the loader arm is being moved.

17. The system of claim 16, wherein the valve command signal is generated such that the valve is controlled in a manner so as to cause the implement to be moved at the adjusted implement speed.

18. The system of claim 12, wherein the controller is further configured to monitor a loader position of the loader arm via at least one position sensor communicatively coupled to the controller.

19. The system of claim 18, wherein the speed control signal is determined as a function of the monitored loader position and the at least one of the monitored fluid pressure or the monitored flow rate of the hydraulic fluid.

20. The system of claim 19, wherein the controller is configured to determine the speed control signal as is function of the monitored loader position, the at least one of the monitored fluid pressure or the monitored flow rate of the hydraulic fluid, and kinematic information associated with a loader geometry of the loader arm.

* * * * *